US005673967A

United States Patent [19]

Wempe

[11] Patent Number: 5,673,967

[45] **Date of Patent: *Oct. 7, 1997**

[54] APPARATUS FOR INTERCONNECTING A LEG REST AND WHEELCHAIR

[76] Inventor: Patrick L. Wempe, 3251B Randolph, Topeka, Kans. 66611

[ * ] Notice: The term of this patent shall not extend beyond the expiration date of Pat. No. 5,556,157.

[21] Appl. No.: 575,855

[22] Filed: Dec. 20, 1995

Related U.S. Application Data

[63] Continuation-in-part of Ser. No. 360,671, Dec. 21, 1994, Pat. No. 5,556,157.

[51] Int. Cl.[6] ..... A47C 1/02

[52] U.S. Cl. ..... 297/68; 297/423.26; 297/DIG. 4

[58] Field of Search ..... 297/68, 71, 90, 297/91, DIG. 4, 358, 362.11, 423.26; 180/907; 280/250.1, 304.1

[56] References Cited

U.S. PATENT DOCUMENTS

| | | |
|---|---|---|
| 2,849,051 | 8/1958 | Streeter, II . |
| 3,858,938 | 1/1975 | Kristensson, et al. . |
| 4,039,223 | 8/1977 | Kristensson . |
| 4,333,681 | 6/1982 | Nelson . |
| 4,339,013 | 7/1982 | Weigt . |
| 4,655,471 | 4/1987 | Peek . |
| 4,966,379 | 10/1990 | Mulholland . |
| 5,044,647 | 9/1991 | Patterson . |
| 5,263,768 | 11/1993 | Scheulderman . |
| 5,297,021 | 3/1994 | Koerlin et al. . |

*Primary Examiner*—Milton Nelson, Jr.

*Attorney, Agent, or Firm*—Kokjer,Kircher, Bowman & Johnson

[57] ABSTRACT

An apparatus for supportably attaching a leg rest to a wheel chair comprising at least one seat frame member and a telescoping linkage slidably received within the seat frame member such that the linkage may be retracted and extended along a telescoping path parallel to a length of the seat frame member. The leg rest is supportably and pivotally attached to a forward end of the telescoping linkage at a hinge point wherein the hinge point is positioned proximate the knee of the user. The leg rest may be pivoted about the hinge point upward to a generally reclined horizontal position when the telescoping linkage is extended and downward to a generally vertical position when the telescoping linkage is retracted.

20 Claims, 3 Drawing Sheets

7.
7.
A
B
C
D
E
90
100
102
104
106
108
110
112
114
116
118
120
122
126
127
128
130
132
133
134
135
136
138
140
142
144
146
148
150
152
154
156
158
9
15

APPARATUS FOR INTERCONNECTING A LEG REST AND WHEELCHAIR

This application is a continuation in part of Ser. No. 08/360,671 filed Dec. 21, 1994, now U.S. Pat. No. 5,556, 157, entitled "No-Shear Power Recline System for Wheelchairs".

BACKGROUND OF THE INVENTION

1. Field of the Invention

The present invention generally relates to a power reclining system mountable to a wheelchair, and in particular, to an apparatus which allows a user to recline within the wheelchair while preventing shearing forces upon the user's back and legs.

2. Description of the Related Art

In the past, wheelchair assemblies have been provided with reclining backrests and extendable leg rest assemblies which operate to move the user's back and legs between upright and reclined positions. Such systems are configured to alleviate pressure and shearing forces which produce skin-related problems. Past systems have been proposed, such as in U.S. Pat. No. 4,655,471 and U.S. Pat. No. 5,297,021. However, these conventional mechanisms contain complicated assemblies located below the subframe to enable the backrest to recline and the leg rest to extend. The complexity of these conventional systems renders them excessively expensive and apt to failure. In addition, these conventional systems utilize a complex actuator and linkage assembly located below the seat to extend the leg rest which increases the overall distance between the floor and seat of the wheelchair.

It is preferable that the seat remain at a lower height to afford the user access to tables, desks, and transportation. The above noted conventional systems excessively raise the seat and overly restrict access to tables, desks, and the like.

Further, the conventional systems necessitate the use of a complex cam and scissor mechanism, along with computer controlled actuators and the like which are unduly expensive and unreliable.

Moreover, the conventional systems provide leg rest assemblies which are unable to accurately follow the motion of a user's leg when being shifted between upright and inclined positions. The leg rest structure of the '021 patent includes a support apparatus having a scissor assembly therein which hinges from a point below the seat and remote from the user's knee. This hinge point remains at a fixed point below the seat frame through extension of the leg rest. Thus, when the user is reclined and simultaneously shifted along a horizontal plane, the leg rest does not follow the motion of the leg.

A need remains within the industry for an improved backrest and leg rest mounted to a wheelchair. It is an object of the present invention to meet this need.

SUMMARY OF THE INVENTION

It is an object of the present invention to provide a backrest section which reclines and a leg rest which articulates, while extending away from the seat base, to closely follow the natural motion of a user when moving from an upright to a horizontally reclined position.

It is a corollary object of the present invention to enable the leg rest and its pivot point to move outward away from the seat as the leg rest is articulated to a horizontal position to minimize shear forces induced upon the user.

It is a further object of the present invention to lower the overall working height of the wheelchair by locating the mechanism controlling the backrest upon the rear of the backrest and by locating the remaining assembly within the seat frame.

It is a corollary object of the present invention to provide flexibility concerning the overall floor to seat height of the wheelchair in order to maximize its versatility for use with tables and the like.

It is a further object of the present invention to reduce the weight of the reclining system by minimizing the working parts therein.

Another object of the present invention is to increase the wheelchair range and performance by reducing wear thereon and by decreasing the wheelchair's structural weight.

Another object of the invention is to provide a reclining mechanism which is easily accessible for service and maintenance without compromising structural integrity.

A corollary object of the present invention is to improve the reliability of the reclining mechanism by reducing the number of moving parts.

Another object of the invention is to provide leg rests which are easily removed and reattached for occupant transferring purposes.

These and other objects are achieved by providing a reclining apparatus which supports a leg rest upon a telescoping linkage running through a seat frame. The telescoping linkage removes the need for cams, actuators, linkages, scissor mechanisms and other external devices found in prior art seats to articulate the leg rests and to recline the backrest. The invention, in one embodiment, is designed for use with a powered wheelchair. The invention utilizes a back portion including a back frame with an attached sliding backrest. The back frame is electro-mechanically powered and pivotally attached to the rearward side of a seat frame, thereby allowing the back portion to angle away from the seat frame in a reclining motion. Leg rests are pivotally supported upon a telescoping linkage which is received within tubular seat frame members. The internal telescoping linkages extend outwardly from the seat frame members in order to extend the leg rest forward away from the seat frame and pivotally upward to a horizontal position. In one embodiment, the telescoping linkage pivotally mounts to an intermediate point along the leg rest. In a second embodiment, the telescoping linkage pivotally mounts to the end of the leg rest. An adjustable bar pivotally engages the seat frame and the leg rest at a point remote from the pivot point in order to cause the leg rest to rotate upward as the telescoping linkage extends. Optionally, tie rods may be mounted between the rear end of the telescoping linkage and the backrest such that when the telescoping linkage moves forward upon reclining the backrest the tie rods pull the backrest downward, thereby eliminating the shearing forces upon the occupant's back when reclining.

BRIEF DESCRIPTION OF THE DRAWINGS

The objects and features of the invention noted above are explained in more detail with reference to the drawings, in which like reference numerals denote like elements, and in which.

DETAILED DESCRIPTION OF TEE INVENTION

Figure 1:
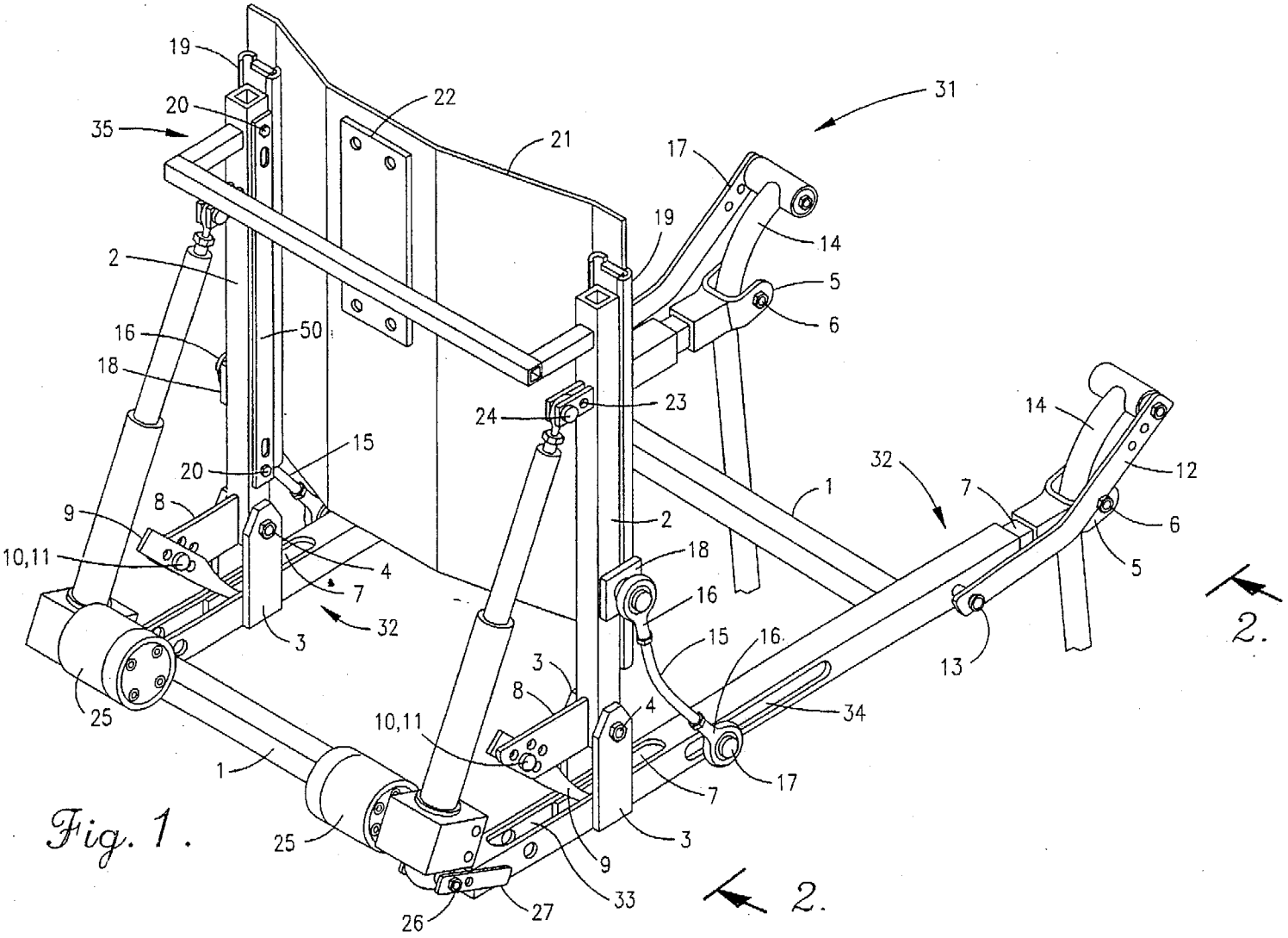
FIG. 1 illustrates a perspective view of the present invention as used with a power reclining system for a wheelchair.

The present invention will now be described in reference to FIGS. 1–4. FIG. 1 shows a generally symmetrical invention 31 having parallel seat frame members 32 laterally attached together with cross bracing 1. Back frame 35 has parallel laterally spaced vertical posts 2 with bottom ends connecting to top ends of posts 3 by use of pins 4. The posts 3 attach vertically to the rearward end of horizontal seat frame members 32. Back frame 35 has glides 19 attached to the front side of vertical posts 2 using screws 20 and brackets 50. Head rest mount 22 fastens to the middle of the upper back side of backrest 21. A backrest 21 made of conventional wheelchair back materials such as plastic, wood or metal (usually covered with custom upholstery not shown) spans the front of vertical posts 2, supported by glides 19.

Figure 4:
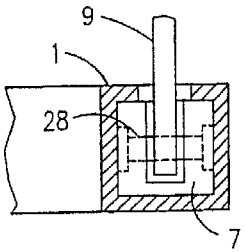
FIG. 4 illustrates a back sectional view of a telescoping linkage taken along line 4—4 in FIG. 2 inside the seat frame member with the connecting linkage pinned to the telescoping linkage.

The upper back sides of the vertical posts 2 have receiver mounts 23 which are pivotally secured to the upper ends of linear actuators 25 via pins 24. Mounting brackets 27 attach to the back end of seat frame members 32 and support the lower ends of linear actuators 25 allowing pivotal movement about pins 26. Adjustment plates 8 are joined to the lower back side of vertical posts 2. Connecting linkages 9 attach to adjustment plates 8 using a pin 10 and clip 11. Connecting linkage 9 joins telescoping linkage 7 using a tension pin 28 as shown in FIG. 4.

Figure 2:
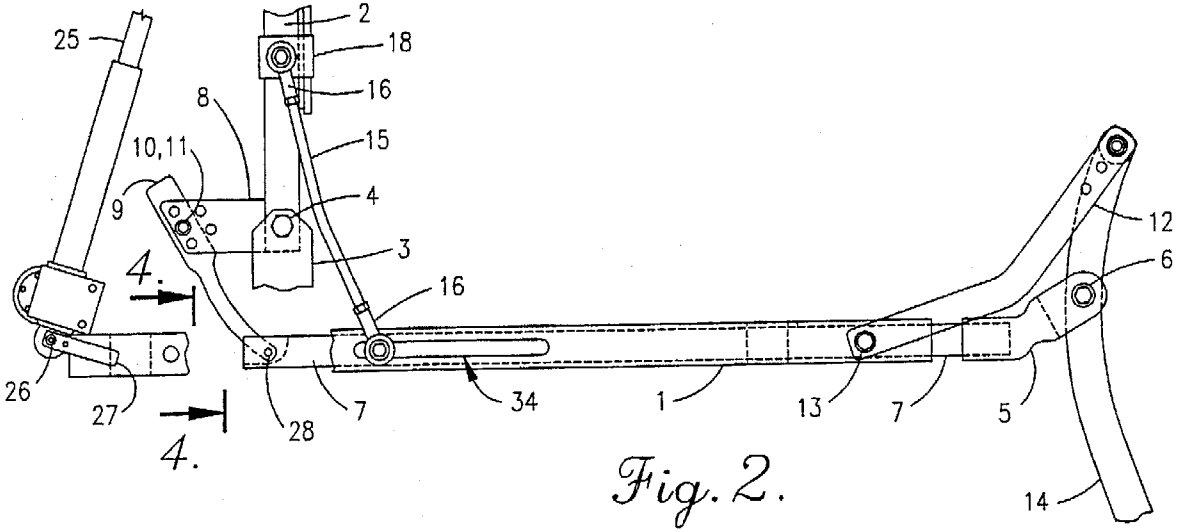
FIG. 2 illustrates a fragmentary side view taken along line 2—2 in FIG. 1 of a seat frame member and associated working mechanism.
Figure 3:
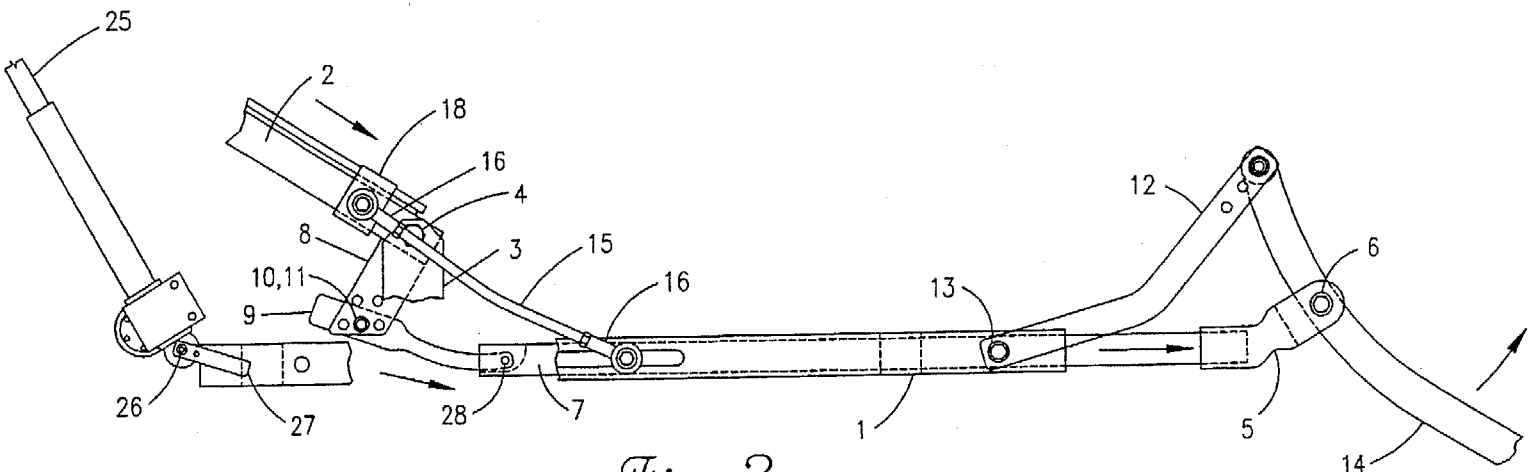
FIG. 3 illustrates a fragmentary side view of the seat frame member and associated working mechanisms of FIG. 2 while in a reclined position.

FIG. 2 and FIG. 3 show that when the vertical post 2 of the back frame 35 is pulled rearwardly down to the reclining position by the linear actuator 25, adjustment plate 8 is forced to rotate downwardly around the axis of pin 4. As adjustment plate 8 moves, it forces connecting linkage 9 to extend telescoping linkage 7 forward through seat frame member 32. In the middle of the outward side of seat frame member 32 there is a slot 34 allowing for attachment and movement of tie rod assembly 15 with knuckles 16 using a bolt 17 threaded into telescoping linkage 7. Tie rod assembly 15 with knuckles 16 attaches to weld clip 18. Weld clip 18 is affixed to glide 19 which supports backrest 21. When the invention 31 reclines and forces the telescoping linkages 7 forward, the linkages 7 pull the backrest 21 forward by means of the tie rod assembly 15, weld clip 18 and glide 19, eliminating the shearing forces to the occupant's back. As the invention 31 is returned to an upright position, the action is reversed, forcing the backrest 21 to slide upwards along vertical posts 2. There are cutouts 33 on the top of the rearward ends of seat frame members 32 allowing adjustment plates 8 and connecting linkages 9 sufficient clearance to complete a rotational arc to fully recline.

In one embodiment of the invention, leg rest 14 is fastened to yoke 5 by pivot pin 6. One end of adjustment bar 12 attaches to the top end of leg rest 14 and the other end of bar 12 fastens to the forward side of seat frame member 32 using a stud 13. Yoke 5 is received over telescoping linkage 7 which protrudes from the forward end of seat frame member 32, as is clearly shown in FIG. 2. As the invention 31 is reclined by linear actuator 25, the back frame 35 is pulled down. The adjustment plate 8 forces connecting linkage 9 to extend telescoping linkage 7 forward, and to extend yoke 5 and leg rest 14 forward. By pinning the top part of leg rest 14 using adjustment bar 12 attached to a stud 13 mounted to seat frame member 32, the leg rest is also forced to articulate upward as is clearly shown in FIG. 3. When the linear actuator 25 is reversed, the entire process is reversed accordingly. It is important to note that changing positions of pin 10 and clip 11 in adjustment plate 8 and connecting linkage 9 changes the overall amount of linear travel induced into the backrest 21 and leg rest 14. Changing where adjustment bar 12 attaches to the top of leg rest 14 changes the amount of upward articulation of the leg rest 14. These adjustments are essential to fitting the invention 31 to a wide variety of users. It is equally important to make clear that the invention 31 is generally symmetrical, having a left and right side connected by cross bracing 1. By varying the length of cross bracing 1, the width of the invention 31 can change to accommodate various widths of users.

Figures 5, 6, 7:
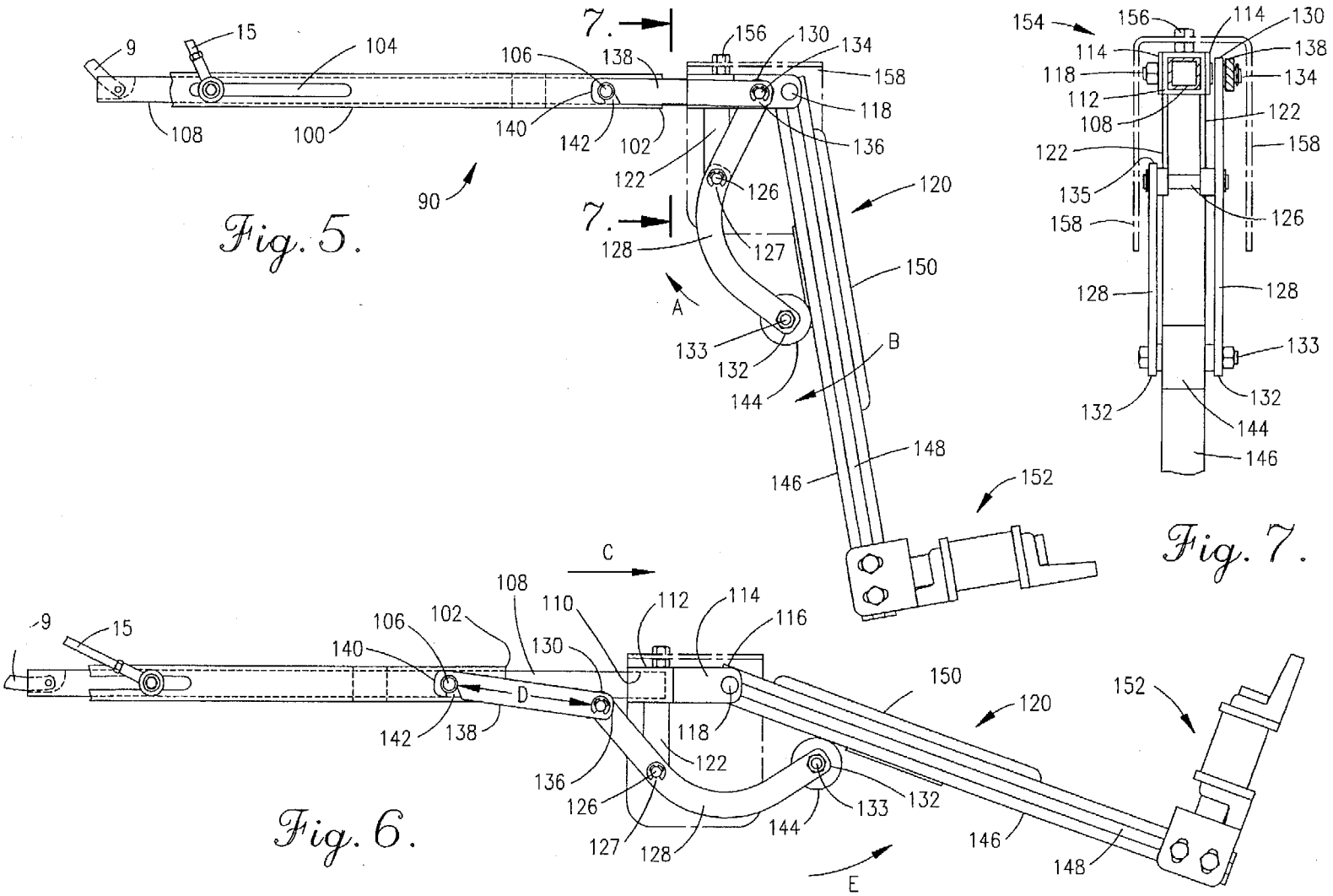
FIG. 5 illustrates a side fragmentary view of an alternative embodiment for the apparatus attaching the leg rest to the telescoping linkage, while in a non-reclining position.
FIG. 6 illustrates a side fragmentary view of the apparatus of FIG. 5 while in a reclined horizontal position.
FIG. 7 illustrates an end view of the apparatus of FIG. 5 taken along lines 7—7.

FIGS. 5–7 illustrate an alternative embodiment for the apparatus mounting the leg rest 14 to the seat frame. Turning to FIG. 5, a seat frame member 100 is illustrated as mounted in a horizontal position proximate the seat of a wheelchair (not shown). The seat frame member 100, in the preferred embodiment, is formed with a rectangular hollow cross-section. The seat frame member 100 includes a forward end 102 located proximate the forward edge of the seat. Optionally, a slit 104 is provided along the rear portion of the outer side of the seat frame member 100. The slit 104 extends along the longitudinal axis of the seat frame member and may have a link corresponding substantially to the length of motion necessary to extend the leg rest to a horizontally reclining position. A pin 106 is provided in the outer side of the seat frame member 100 proximate the forward end 102. The seat frame member 100 slidably receives a telescoping support beam 108 along its interior. The support beam 108 moves in a direction parallel to a longitudinal axis of the seat frame member 100 between a retracted position (see FIG. 5) and an extended position (see FIG. 6). The support beam 108 includes an outer end 110 (FIG. 6) which is securely mounted to an end cap 112. The end cap 112 includes a pair of outwardly projecting brackets 114 aligned parallel with one another and extending forward of the cap 112. The brackets 114 are pivotally mounted, via a pin 118, to a rear end 116 of the leg rest 120. The brackets 114 support the weight of the leg rest and the user's legs resting thereon.

The end cap 112 further includes a base 122 projecting downward therefrom along a substantially vertical axis. The lower end of the base 122 pivotally engages, via a pin 126, a rocker arm 128. The rocker arm 128 is arcuately shaped, such as an L-shape, a U-shape and the like. The rocker arm 128 includes a hole 127 located at an intermediate point along its length to pivotally receive the pin 126. The rocker arm 128 includes a rear end 130 and a forward end 132. The rear end 130 is hingeably mounted, via a pin 134 to a forward end 136 of an adjustment bar 138. The adjustment bar 138 includes a notch 142 therein proximate the rear end 140 of the adjustment bar. The notch 142 hooks over pin 106 for adjustments within the fixed distance between the pin 106 and the rear end 130 of the rocker arm 128.

The rocker arm 128 includes a roller 144 mounted upon its outer end to engage a rear surface 146 of a leg rest brace 148. The leg rest 120 further includes a pad 150 mounted to the brace 148 to support the calf portion of a user's leg. A foot supporting bracket 152 is mounted to the lower end of the brace 148 to support the user's foot.

As illustrated in FIG. 7, each leg rest supporting apparatus 90 may include corresponding inner and outer rocker arms 128 aligned parallel to one another, both of which include lower ends 132 which rotatably support the roller 144. Optionally, a protective housing 154 may be secured via bolts 156 to the end cap 112 to prevent injuries while the rocker arms 128 are moving.

The roller 144 is pivotally mounted on a pin 133 projecting between the rocker arms 128. Optionally, the inner rocker arm 128 may simply represent a straight or arcuate bar having a lower end 132 and an upper end 135. The upper end 135 is pivotally mounted to the pin 126.

Next, the operation of the leg rest will be described in connection with FIGS. 5–7. Initially, the leg rest 120 is positioned in an upright position (FIG. 5) with the brace 148 aligned substantially vertically. When in the upright position, the telescoping support beam 108 is contracted with its outer end 110 located proximate the forward end 102 of the seat frame member 100. When the outer end 110 is so located, the base member 122 is similarly located proximate the forward end 102, thereby rotating the rocker arm 128 in the direction of arrow A (FIG. 5). As the rocker arm 128 rotates about the pivot point 126 in the direction of arrow A, the roller 144 similarly rotates along an arcuate path as shown by arrow B downward and inward to a position below the telescoping support beam 108. When located as shown in FIG. 5, the roller 144 allows the brace 148 to pivot about a pivot point defined by the pin 118. Throughout rotation, the leg rest 120 is entirely supported by the telescoping support beam 108.

Next, operation of the leg rest supporting apparatus 90 is described while the leg rest 120 is moved to a reclined position (at which the brace 148 is aligned along a substantially horizontal axis). To effect the reclining motion, the telescoping support beam 108 is forced forward along a telescoping path parallel to the longitudinal axis of the seat frame member 100. The support beam 108 may be driven forward by a variety of mechanical, electrical and other actuating means. It is to be understood that the support beam 108 may, but need not necessarily be directly connected to the backrest (as shown in FIG. 1) and driven by reclining the back rest. Instead, the support beam 108 may be separately controlled by actuator means or by manual means. When the support beam 108 is driven forward, the end cap 112 similarly is forced forward to a position remote from the forward end 102 of the seat frame member 100. As the end cap 112 moves in the direction of arrow C (FIG. 6), the base 122 follows this linear motion which forces the pin 126 forward along the path C. During movement, the base 122 moves from a position behind the pivot point defined by pin 134 to a position forward thereof. Throughout movement of the telescoping support beam 108, the adjustment bar 138 maintains a fixed distance D between the rear end 130 of the rocker arm 128 and the pin 106. The brace 122 and the bar 138 cooperate to effect pivotal motion of the rocker arm 128 about the pivot point defined by pin 126 (as denoted by arrow E in FIG. 6). As the rocker arm 128 pivots in this manner, the roller 144 is driven along an arcuate path forward and upward. Throughout movement, the roller 144 abuts against the rear face 146 of the brace 148. The arcuate motion of the roller 144 effects a pivoting lever force upon the brace 148 causing the leg rest 120 to pivot upward about the hinge pin 118. Throughout upward movement of the leg rest 128, the support beam 108 supports substantially all of the weight upon the leg rest 120.

It will be understood that other means for moving the leg rest about the hinge point are contemplated by, and would be in accordance with, this invention. For example, instead of using roller 144, a sliding means could alternatively be mounted to the outer end of the rocker arm and slidably received within a track along the rear surface 146 of brace 148. Similarly to the roller, the sliding means would be driven along an arcuate path forward and upward within the track moving the brace upward as the rocker arm pivots.

The above described structure provides an apparatus for supporting a leg rest which closely follows the arcuate path of a leg when bending at the knee while the user is being reclined. The foregoing advantages are achieved by locating the hinge point of the leg rest immediately adjacent the knee and by utilizing a telescopic linkage between the support beam 108 and the seat frame 100 to move the hinge point of the leg rest 120 with the user's leg as the user is reclined.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. An apparatus for supportably attaching a leg rest to a wheel chair, said leg rest supporting a leg of a user, said apparatus comprising:

at least one seat frame member;

at least one telescoping linkage slidably received within said seat frame member, said linkage telescoping between retracted and extended positions along a telescoping path parallel to a length of said seat frame member; and at least one leg rest supportably and pivotally mounted at a hinge point to a forward end of said telescoping linkage, said leg rest pivoting about said hinge point, said telescoping linkage moving said hinge point and said leg rest along said telescoping path to move said leg rest forward and backward in a direction parallel to said length of said seat frame member.

2. The apparatus of claim 1, wherein said leg rest has an upper end positioned proximate a knee of the user and wherein said upper end of the leg rest is pivotally mounted at said hinge point to the forward end of the telescoping linkage.

3. The apparatus of claim 2, wherein said leg rest has a lower end positioned proximate a foot of the user.

4. The apparatus of claim 2, wherein said apparatus additionally includes means for pivoting the leg rest about said hinge point upward to a generally horizontal position aligned parallel said length of said seat frame member when said telescoping linkage is moved to the extended position, and downward to a generally vertical position when the telescoping linkage is moved to said retracted position.

5. The apparatus of claim 1, wherein said apparatus additionally includes means for pivoting the leg rest about said hinge point upward to a generally horizontal position aligned parallel said length of said seat frame member when said telescoping linkage is moved to the extended position, and downward to a generally vertical position when the telescoping linkage is moved to said retracted position.

6. The apparatus of claim 5, wherein said leg rest is pivotally mounted at the hinge point to an end cap securely mounted to the forward end of the telescoping linkage.

7. The apparatus of claim 6, wherein said means for pivoting the leg rest comprises:

a base projecting downward from said end cap along a substantially vertical axis;

a rocker arm having a mounting end and a contacting end, said rocker arm pivotally attached to a lower end of said base at an intermediate point along the length of the rocker arm, wherein the mounting end of said rocker arm is pivotally mounted to the seat frame member; and a leg rest contacting means mounted to the contacting end of said rocker arm for moving contact with a rear surface of said leg rest.

8. The apparatus of claim 7, wherein said rocker arm is arcuately shaped.

9. The apparatus of claim 7, wherein said leg rest contacting means comprises a roller mounted to the contacting end of said rocker arm which engages a rear surface of the leg rest.

10. The apparatus of claim 7, wherein said rocker arm is mounted to the seat frame member by pivotally mounting said rocker arm at a pivot point to an adjustment bar extending forward of the seat frame member.

11. The apparatus of claim 10, wherein said base is positioned intermediate said pivot point and said seat frame member when the telescoping linkage is in the retracted position and wherein said pivot point is positioned intermediate said base and said seat frame member when the telescoping linkage is in the extended position.

12. An apparatus for supportably attaching a leg rest to a wheel chair, said leg rest supporting a leg of a user, said apparatus comprising:

at least one seat frame member;

at least one telescoping linkage slidably received within said seat frame member, said linkage telescoping between retracted and extended positions along a telescoping path parallel to a length of said seat frame member; and at least one leg rest supportably and pivotally mounted at a hinge point to a forward end of said telescoping linkage, said leg rest pivoting about said hinge point, said telescoping linkage moving said hinge point and said leg rest along said telescoping path to move said leg rest forward and backward in a direction parallel to said length of said seat frame member, said leg rest having an upper end positioned proximate a knee of the user and wherein said upper end of the leg rest is pivotally mounted at said hinge point to the forward end of the telescoping linkage;

means for pivoting the leg rest about said hinge point upward to a generally horizontal position aligned parallel said length of said seat frame member said telescoping linkage is moved to the extended position, and downward to a generally vertical position when the telescoping linkage is moved to said retracted position.

13. The apparatus of claim 12, wherein said apparatus is pivotally mounted at the hinge point to an end cap securely mounted to the forward end of the telescoping linkage.

14. The apparatus of claim 13, wherein said means for pivoting the leg rest comprises:

a base projecting downward from said end cap along a substantially vertical axis;

a rocker arm having a mounting end and a contacting end, said rocker arm pivotally attached to a lower end of said base at an intermediate point along the length of the rocker arm, wherein the mounting end of said rocker arm is pivotally mounted to the seat frame member; and a leg rest contacting means mounted to the contacting end of said rocker arm for moving contact with a rear surface of said leg rest.

15. The apparatus of claim 14, wherein said rocker arm is arcuately shaped.

16. The apparatus of claim 14, wherein said leg rest contacting means comprises a roller mounted to the contacting end of said rocker arm which engages a rear surface of the leg rest.

17. The apparatus of claim 14, wherein said rocker arm is mounted to the seat frame member by pivotally mounting said rocker arm at a pivot point to an adjustment bar extending forward of the seat frame member.

18. The apparatus of claim 17, wherein said base is positioned intermediate said pivot point and said seat frame member when the telescoping linkage is in the retracted position and wherein said base is positioned intermediate said base and said seat frame member when said telescoping linkage is in the extended position.

19. An apparatus for attachment to a wheelchair, comprising:

at least one seat frame member;

at least one telescoping linkage slidably received within said seat frame member, said linkage telescoping between retracted and extended positions along a telescoping path parallel to a length of said seat frame member; and at least one leg rest supportably and pivotally mounted at a hinge point to a forward end of said telescoping linkage, said leg rest pivoting about said hinge point, said telescoping linkage moving said hinge point and said leg rest along said telescoping path to move said leg rest forward and backward in a direction parallel to said length of said seat frame member, said leg rest having an upper end positioned proximate a knee of a user and wherein said upper end of the leg rest is pivotally mounted at said hinge point to the forward end of the telescoping linkage;

means for pivoting the leg rest about said hinge point upward to a generally horizontal position aligned parallel said length of said seat frame member when said telescoping linkage is moved to the extended position, and downward to a generally vertical position when the telescoping linkage is moved to said retracted position;

a back frame for supporting a back of a user, said backframe including a bottom end pivotally mounted to said seat frame member;

extension means for forcing said linkage to extend forward from said seat frame member; and retraction means for forcing said linkage to retract rearward into said seat frame member.

20. The apparatus of claim 19, wherein said extension means includes a connecting linkage mounted to said back frame and having an outer end which engages a rear end of said telescoping linkage to drive said telescoping linkage toward said extended position as said back frame pivots toward a reclined position.

* * * * *